United States Patent [19]

Copas

[11] Patent Number: 4,465,435

[45] Date of Patent: Aug. 14, 1984

[54] APPARATUS FOR USING NATURAL GAS PRESSURE FOR PUMPING A WELL

[76] Inventor: James I. Copas, P.O. Box 2109 SE. 12, Oklahoma City, Okla. 73129

[21] Appl. No.: 371,553

[22] Filed: Apr. 26, 1982

[51] Int. Cl.[3] ..... F04B 47/12

[52] U.S. Cl. ..... 417/56

[58] Field of Search ..... 417/56, 57, 58, 59, 417/60

[56] References Cited

U.S. PATENT DOCUMENTS

| | | | |
|---|---|---|---|
| 3,053,188 | 9/1962 | Dinning et al. | 417/56 X |
| 3,095,819 | 7/1963 | Brown et al. | 417/57 |
| 3,181,470 | 5/1965 | Clingman | 417/56 |
| 3,351,021 | 11/1967 | Moore | 417/57 |

FOREIGN PATENT DOCUMENTS

| | | | |
|---|---|---|---|
| 523801 | 4/1956 | Canada | 417/56 |
| 597835 | 5/1960 | Canada | 417/56 |

*Primary Examiner*—Richard E. Gluck
*Attorney, Agent, or Firm*—Dunlap & Codding

[57] ABSTRACT

An apparatus for periodically raising a quantity of liquid from a well to the earth's surface comprises a piston assembly above which the liquid collects in a tubing in which the piston assembly slides, the piston assembly including a piston member having an outside diameter slightly smaller than the inside diameter of the tubing to permit liquid to seep about the piston member and accumulate above the piston assembly near the lower end of the tubing. An outlet on the tubing is periodically opened via a timed valve to permit natural gas pressure in the well to drive the piston assembly to the surface. The piston assembly includes a mandrel which carries a slide valve disposed to be closed when the piston assembly is at rest and to be opened by deceleration of the mandrel. An arresting assembly at the top of the tubing is engaged by the upwardly moving mandrel to cause the slide valve to open and thereby relieve natural gas pressure below the piston assembly to return the piston assembly to the lower end of the tubing at the end of each operating cycle.

3 Claims, 4 Drawing Figures

APPARATUS FOR USING NATURAL GAS PRESSURE FOR PUMPING A WELL

BACKGROUND OF THE INVENTION

1. Field of the Invention

The present invention relates generally to gas lift systems for raising liquids in a well to the earth's surface and, more particularly, but not by way of limitation, to gas lift systems for oil wells.

2. Brief Description of the Prior Art

The operation of a gas lift pumping system has been generally described in my U.S. Pat. No. 2,893,493, issued July 7, 1959. As described in that patent, a gas lift system comprises a tubing which extends into a well for receiving liquids in the well and delivering them to the surface. The tubing is enclosed in a casing so that pressurized gas can be introduced into the annulus between the tubing and casing to provide the motive force for driving the liquids to the earth's surface. In order to prevent the pressurized gas from escaping through the tubing, a piston, generally known as a "traveling rabbit," is mounted in the tubing so that the introduction of pressurized gas into the well causes the piston to rise in the tubing to deliver any liquids above the piston to an outlet conduit that is in fluid communication with the tubing. The piston is provided with a valve mechanism that opens when the piston is dropped down the tubing and closes when pressurized gas is introduced into the well. A plunger near the upper end of the tubing catches the piston so that liquid can be permitted to accumulate in the tubing between operations of the system.

The operation of such a system begins with the actuation of the plunger to permit the piston to fall to a stop located near the lower end of the tubing so as to be immersed in the accumulated liquid. Since the valve mechanism is open during this fall, the piston will enter the accumulated liquid with such liquid passing inwardly through the piston during the passage of the piston through the liquid. When the pressurized gas is subsequently introduced into the well, the pressure exerted on the piston causes the valve mechanism therein to close and then forces the piston, and the liquid in the tubing above the piston, up the tubing to the outlet conduit from which the liquid is delivered from the well.

While a gas lift system of this type has many advantages, it also has drawbacks, the major one of which is the need in the prior art systems for a human attendant to operate the system. That is, the attendant actuates the plunger and subsequently introduces the pressurized gas into the annulus between the casing and the tubing. Additionally, the use of pressurized gas as the motive force for raising the liquids requires that the well be provided with a compressor which is both expensive and costly to operate. The present invention provides an improved gas lift system that eliminates these and other disadvantages of the prior art systems.

SUMMARY OF THE INVENTION

Liquids that are to be pumped from a well are often produced from a formation that also produces significant quantities of natural gas which can, if the well is closed, build up to a pressure which is sufficient to raise the piston of a gas lift system and a quantity of liquid disposed thereabove to the earth's surface. Moreover, if this pressure is relieved, the time required for a subsequent build up of pressure sufficient to raise the piston is often uniform over long periods of time; that is, a well in which pressure is intermittently relieved will often exhibit a well defined pressure "fingerprint" that is characteristic of the well and can be measured. The present invention exploits these well characteristics to provide a gas lift system that utilizes natural gas pressure to periodically deliver a quantity of liquid from the bottom of a well to the earth's surface without the requirement of human intervention to accomplish such delivery.

To this end, a piston member, that is disposed in the tubing of the present gas lift system and forms a part of a piston assembly, is constructed to have an outside diameter that is slightly smaller than the inside diameter of the tubing so that liquid will seep about the piston member at such times that the piston member is at rest at the lower end of the tubing. On the other hand, since the difference in these two diameters is small, the piston member can still provide an effective seal with the tubing under dynamic conditions in which natural gas pressure is permitted to drive the piston member upwardly in the tubing. Under such conditions, the liquid between the periphery of the piston member and the internal wall of the tubing effectively becomes a part of the piston member so that the piston member, and liquid above the piston member, can be driven upwardly by releasing pressure in portions of the tubing disposed above the piston member. Such release is accomplished in the present invention via a timed valve on an outlet conduit that is connected to the tubing to receive liquid delivered to the top of the tubing.

The piston member is mounted on a mandrel which carries a slide valve disposed thereon to open a fluid path through the mandrel when the mandrel is arrested at the top of the tubing by a mandrel arresting assembly provided for that purpose. Thus, at the end of the delivery of fluid to the outlet, pressure below the piston member is released so that the piston member can return to a position near the lower end of the well. The slide valve then operates under the influence of gravity to close the fluid path.

Following the discharge of liquid above the piston member from the tubing, the timed valve closes for a period sufficient for natural gas to accumulate in the well to a pressure which is again sufficient to drive the piston assembly, along with a quantity of liquid above the piston assembly, to the surface. During this time, pressure in the tubing will tend to equalize with the well pressure while liquid seeps about the piston member to again prepare the gas lift system for delivery of a subsequent quantity of liquid to the surface. Thereafter, the operation of the system is periodically and automatically repeated by periodic operation of the timed valve.

An object of the present invention is to provide a gas lift pumping system that operates without human intervention.

Another object of the present invention is to provide an oil well pumping system which utilizes natural gas pressure as the motive force for pumping the well, thereby eliminating a large portion of operating costs that might otherwise be entailed in the operation of a well pumping system.

Other objects, advantages and features of the present invention will become clear from the following detailed description of the preferred embodiment of the invention when read in conjunction with the drawings and appended claims.

BRIEF DESCRIPTION OF THE DRAWINGS

FIG. 1A shows upper portions of the apparatus, FIG. 1B shows intermediate portions of the apparatus, and FIG. 1C shows lower portions of the apparatus.

DESCRIPTION OF THE PREFERRED EMBODIMENT

Figures 1A, 2:
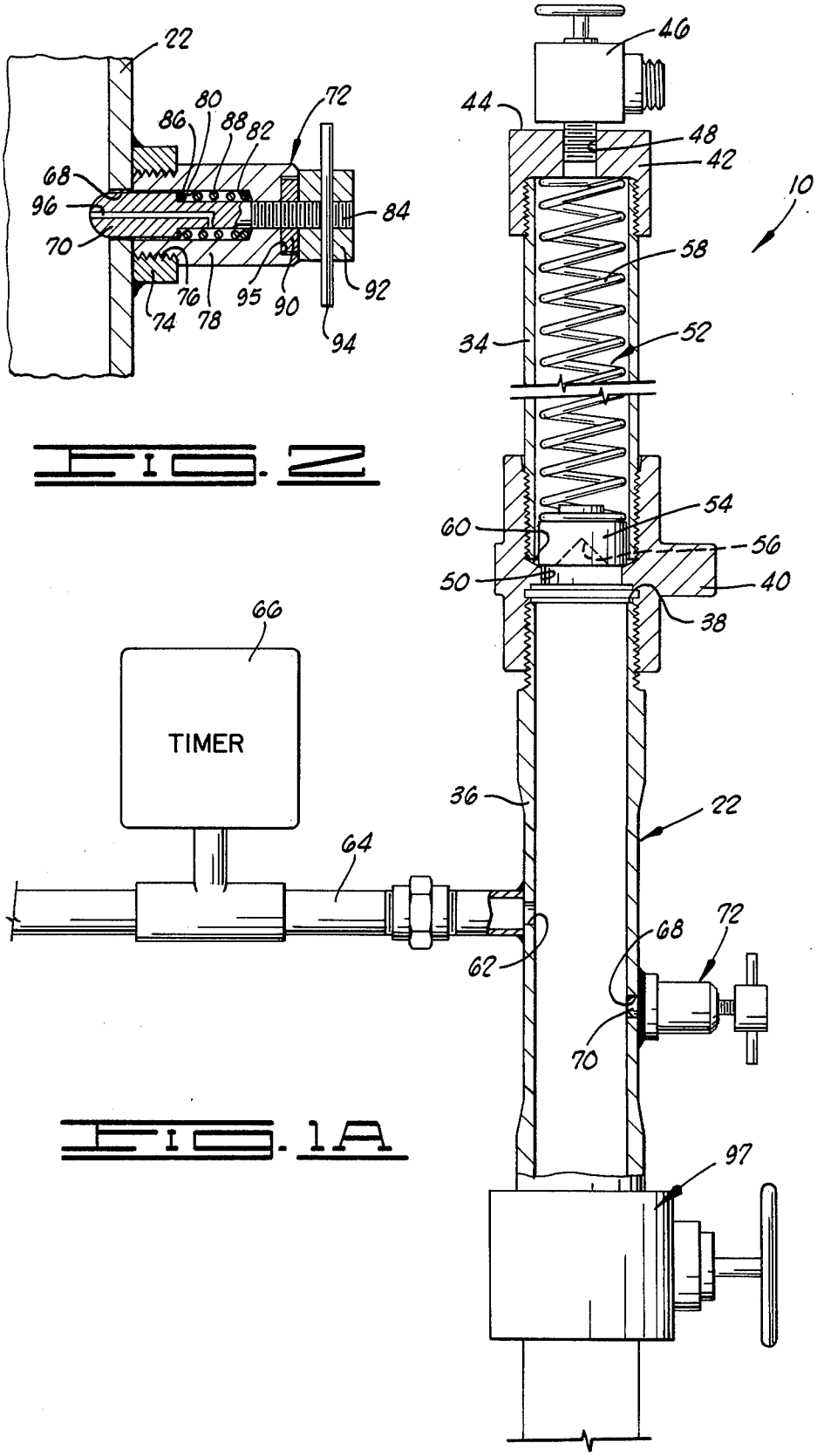
FIGS. 1A, 1B and 1C provide a vertical cross section of the gas lift apparatus of the present invention.
FIG. 2 is a cross section of the catcher assembly of the apparatus drawn to an enlarged scale.
Figure 1B:
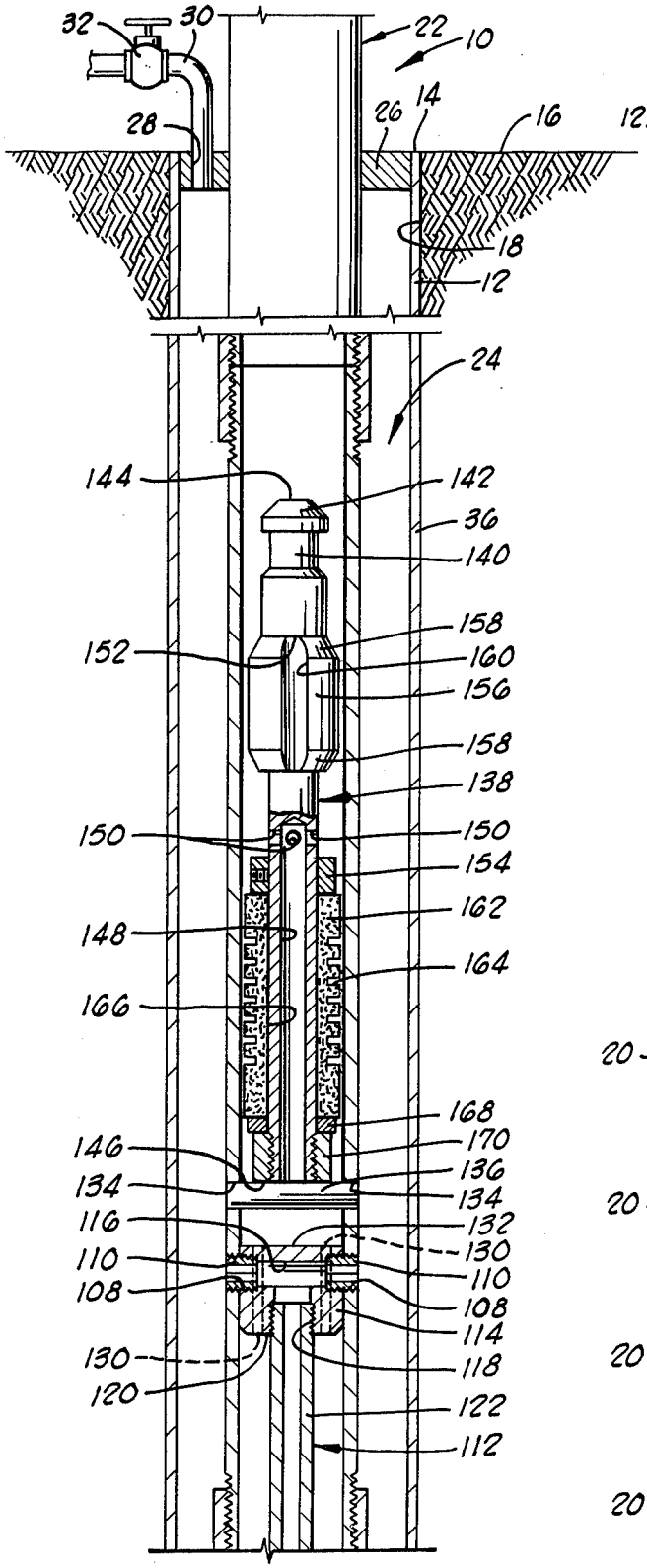
Figure 1C:
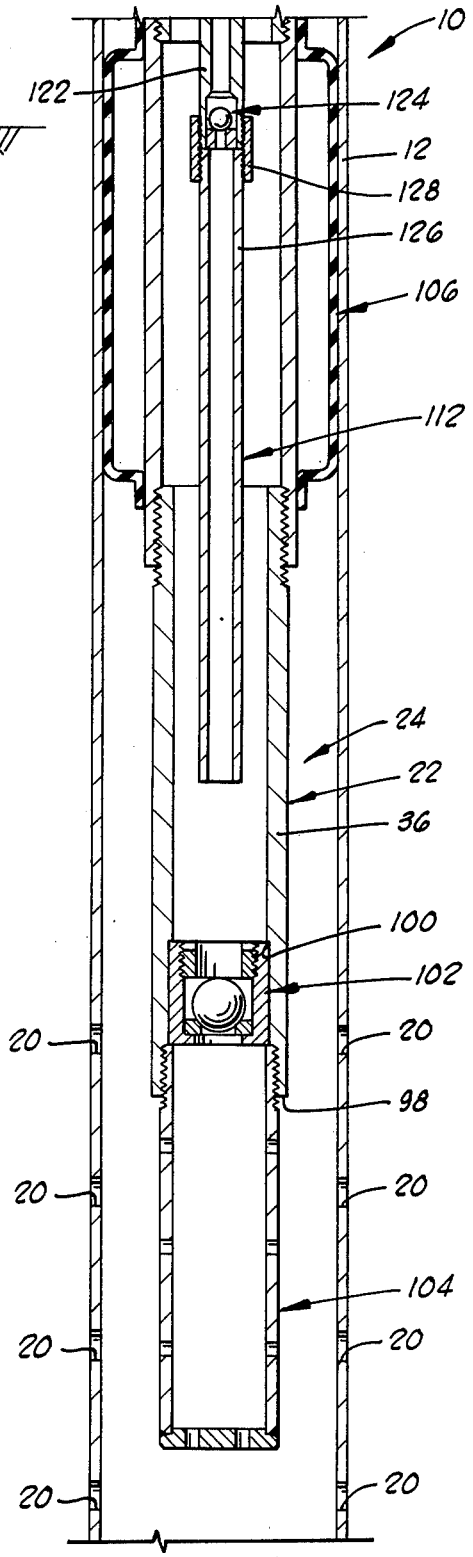

Referring now to the drawings in general and to FIGS. 1A, 1B and 1C in particular, shown therein and designated by the general reference numeral 10 is an apparatus constructed in accordance with the present invention to use natural gas pressure in a well to pump liquid from the well. As is particularly shown in FIGS. 1B and 1C, the apparatus 10 comprises a casing 12 that has an upper end 14 adjacent the earth's surface 16, the casing 12 extending downwardly from its upper end 14 into a well as indicated by the borehole 18. The casing 12 extends to a subterranean formation (not shown) that produces liquids to be recovered and a portion of the casing 12 within the formation is provided with a plurality of perforations 20 (FIG. 1C) to permit such liquids and natural gas produced by the formation to enter the casing 12.

The apparatus 10 further comprises a tubing, generally indicated by the numeral 22 in FIGS. 1A, 1B and 1C, that passes through the upper end 14 of the casing 12 and extends downwardly within the casing 12 to a position near the perforations 20 as is particularly shown in FIG. 1C. The casing 12 and tubing 22 define an annular spacing 24 that is closed at its upper end by a packing member 26 that forms a seal between the casing 12 and tubing 22. In one preferred embodiment of the apparatus 10, an aperture 28 is formed through the packing member 26 and a pipe 30 is fixed in the aperture 28 and sealed to the packing member 26 to permit compressed gas to be introduced into the annular spacing 24 from a suitable source which has not been shown. A valve 32 is mounted in the pipe 30 to permit the upper end of the annular spacing 24 to be closed at such times that compressed gas is not used in the operation of the apparatus 10; that is, at such times that the apparatus 10 undergoes normal operation in which natural gas pressure is used to raise liquids which have accumulated in the casing 12 and the tubing 22 from the well.

Referring specifically to FIG. 1A, the tubing 22 comprises an upper portion 34 positioned above the casing 12 and a lower portion 36 which extends into the casing 12. As has been indicated in FIG. 1B, the lower portion 36 of the tubing 22 being comprised of a plurality of sections of pipe as has also been indicated in FIGS. 1B and 1C. The upper portion 34 of the tubing 22 is attached to the upper end 38 of the lower portion 36 via a hammer type coupler 40 and is provided with a cap 42 so that the tubing 22 has a closed upper end 44. Pressure within the tubing 22 can be released via a conventional valve 46 mounted on the cap 42 and communicating with the interior of the tubing 22 via a threaded bore 48 formed through the cap 42 into which a portion of the valve 46 screws.

The coupling 40 has a bore 50 formed therethrough to communicate the two portions of the tubing 22, and the upper portion 34 of the tubing 22 forms a housing for a mandrel arresting assembly 52 whose purpose will be discussed below. In the preferred embodiment of the invention, the mandrel arresting assembly 52 comprises a piston 54, having a conical concavity 56 in the side thereof facing the well, and a compression spring 58 which extends between the piston 54 and the cap 42 to bias the piston 54 against an internal shoulder 60 formed in the coupling 40 about the bore 50 therethrough.

An aperture 62 is formed through the wall of the lower portion 36 of the tubing 22, a short distance below the coupler 40, and an outlet conduit 64 is welded to the tubing 22 about the aperture 62 to deliver the effluent of the well from the tubing 22 to conventional separation and storage equipment (not shown) which need not be discussed for purposes of the present disclosure. A timer operated valve 66 is disposed in the outlet conduit 64 so that the outlet conduit 64 can be periodically opened and closed in accordance with a preselected schedule. Such valves are conventional and, accordingly, need not be further discussed herein.

A second aperture 68 is formed through the wall of the tubing 22 below the aperture 62 to permit a plunger 70, forming a part of the catcher assembly 72 to be extended into the tubing 22. As shown in FIG. 2, the catcher assembly comprises, in addition to the plunger 70, a bushing 74 which is welded to the outer periphery of the tubing 22 about the aperture 68. The bushing 74 has a threaded bore 76 into which a catcher assembly body 78 is screwed. A bore 80 is formed axially through the body 78 and portions of the bore 80 near the end thereof abutting the tubing 22 are formed on an enlarged diameter to form an internal shoulder 82 in the bore 80 facing the tubing 22. The plunger has a reduced diameter shank 84 so that a corresponding shoulder 86 is formed on the plunger to face the shoulder 82.

A compression spring 88 mounted on the shank 84 between the shoulders 82 and 86 is used to urge the plunger 70 into the tubing 22. (An O-ring and washer can be interposed between the compression spring 88 and shoulder 82 to seal the catcher assembly 72. For clarity of illustration, the O-ring and washer have not been shown in FIG. 2.) The shank 84 of the plunger 70 is threaded over a substantial portion of its length to receive a nut 90 and an operating handle comprised of a knob 92 and a pin 94 that passes through holes (not numerically designated in the drawings) formed laterally through the shank 84 of the plunger 70 and through the knob 92. The nut 90 can, as shown in FIG. 2, fit within a correspondingly shaped recess 95 in the outer end of the body 78 to position the inner end of the plunger 70 in the tubing 22. Alternately, the nut 90 can be withdrawn from the recess 95 and turned about 90° by manipulation of the handle 94, to engage the outer end of the body 78 and hold the inner end of the plunger 70 out of the tubing 22. Pressure relief within the body 78 is provided by a port 96 formed longitudinally through larger diameter portions of the plunger 70, the port 96 having a lateral extension to the surface of the shank 84.

Returning now to the tubing 22 and referring particularly to FIG. 1A, the apparatus 10 further includes a valve 97 which is disposed in the tubing 22 so that above ground portions of the tubing 22 can be isolated from portions of the tubing 22 disposed in the well. As will become clear below, it will at times become necessary to open the upper end of the tubing 22 and the valve 97 is used to close in the well at such times. In order that the valve 97 will not interfere with the operation of the apparatus 10 to be discussed below, the valve 97 is selected to be a full bore valve; that is, the valve 97 is selected to have a flow passage, when open, that has a diameter equal to the inside diameter of the tubing 22.

Referring now to FIG. 1C, the lower portion 36 of the tubing 22 terminates in an open lower end 97 within the perforated portion of the casing 12. In one preferred embodiment of the invention, portions of the tubing 22 adjacent the lower end 100 thereof are counterbored to provide the casing with an internal shoulder 100 that engages the upper end of a standing valve 102 that is mounted in the tubing 22 near the lower end 98 thereof. The valve 102, which is positioned to permit fluids to pss from the casing 12 into the tubing 22, but to prevent the reverse flow of fluids, is conveniently held in place via a strainer 104 that screws into the lower end 98 of the tubing 22.

As further shown in FIG. 1C, a downhole packer 106 is mounted on the tubing 22 above the lower end 98 thereof and engages the inside wall of the casing 12 to divide the annulus 24 between the casing 12 and tubing 22 into non-communicating upper and lower portions. As will be clear from FIGS. 1B and 1C, the lower portion of the annulus 24 thus receives fluids produced by the formation into which the apparatus 10 extends, while the upper portion of the annulus 24 forms a conduit which extends to the earth's surface and is in fluid communication with the pipe 30 that extends to a source of compressed gas.

Above the downhole packer 106, apertures 108 are formed through the wall of the tubing 22 and the apertures 108 are threaded to receive bored plugs 110 that form a portion of a standing valve assembly 112 partially shown in FIG. 1B and continued into FIG. 1B. The valve assembly 112, which is fluidly communicated with the annulus 24 via the apertures 108, coacts with the downhole packer 106 and valve 102 to permit compressed gas to be introduced into portions of the tubing 22 above the lower end 98 thereof, without affecting the flow of fluids into the casing 12, for a purpose to be discussed below. To this end, the valve assembly 112 further comprises a cylindrical vent body 114 which is mounted in the tubing 22 and has a lateral bore 116 that extends through the vent body to receive portions of the plugs 110. That is, the vent body 114 is mounted in the tubing 22 by aligning the bore 116 with the apertures 108 before screwing the plugs 110 into the apertures 108. A second bore 118, lower portions of which are threaded, is formed through portions of the vent body to intersect the bore 116 and the lower end 120 of the vent body 114 so that a tube 122 can be screwed thereinto. As shown in FIG. 1C, the lower end of the tube 122 is counterbored to receive a standing valve 124 that is positioned to pass fluids from the upper portion of the annulus 24, via the bores 116 and 118 and the tube 122, into the tubing 22 while preventing the passage of fluid from the tubing 22 upwardly through the valve 124. An extension tube 126 is connected to the lower end of the tube 124 via a suitable coupling 128. In order to prevent the vent body 114 from obstructing the flow of fluid through the tubing 22, a plurality of passages 130, two of which have been indicated by dashed lines in FIG. 1B, are formed through the vent body 114 to intersect the upper end 132 and lower end 120 thereof.

Above the valve assembly 112, two diametrically opposed apertures 134 are formed through the wall of the tubing 22 and a pin 136 is mounted in the apertures 134 to form a stop for a piston assembly 138 which slides in the tubing 22 to deliver liquid from the well to the outlet conduit 64 as will be described below. (In oder to more clearly bring out the structure of the piston assembly 138, such assembly has been drawn in a configuration different from the configuration the piston assembly will assume at such times that the piston assembly rests upon the pin 136.)

The piston assembly 138 comprises a mandrel 140 which has a frusto-conical head 142 to mate with the conical concavity 56 in the piston 54 of the mandrel arresting assembly 52 at its upper end 144 and extends downwardly from the upper end 144 to a lower end 146. A bore 148 is formed through lower portions of the mandrel 140, the bore 148 intersecting the lower end 146 of the mandrel 140 and extending into the mandrel 140 approximately half the length of the mandrel 140. A plurality of ports 150 are formed between the bore 148 and the outer periphery of the mandrel 140 to form a fluid path through the piston assembly 138 at such times that such ports 150 are uncovered. A shoulder 152 is formed on the mandrel 140 above the ports 150 and a ring 154 is secured to the mandrel 140 below the ports 150. The bore 148, ports 150, shoulder 152 and ring 154 form a portion of a sliding valve assembly which further comprises a slide 156 that has the form of a sleeve that is mounted on the mandrel 140 for sliding movement thereon between the shoulder 152 and the ring 154. The slide 156 has frusto-conical end portions 158 and three grooves 160, only one of which has been illustrated, are formed in the periphery of the slide 156 to extend substantially the length of the slide 156. The grooves 160 and frusto-conical portions 158 prevent natural gas from collecting under the slide 156, at such times that the piston assembly rests upon the pin 136, and thereby possibly raising the slide to the position shown in FIG. 1B such that the fluid path through the piston assembly 138 would be open with the piston assembly resting upon the pin 136. Rather, the weight of the slide 156 will cause the slide 156 to rest upon the ring 154 at such times that the piston assembly 138 is disposed near the lower end of the tubing 22 in the position illustrated in the drawings. As will be discussed below, the slide 156 overlays the ports 150 at such times that the piston assembly 138 is driven up the tubing 22 and is in the position shown in FIG. 1B when the piston assembly 138 falls within the tubing 22. To insure that the slide 156 will assume such positions when the piston assembly 138 is moving, the slide 156 is constructed to have an outside diameter only slightly smaller than the inside diameter of the tubing 22 so that the slide 158 will tend to occasionally engage the tubing 22, such engagement urging the slide 156 in a direction opposite the direction of movement of the piston assembly 138.

The piston assembly 138 further comprises a piston member 162 which is preferably made of nylon and is disposed below the ring 154. The piston member 162 is constructed to have a diameter slightly smaller than the inside diameter of the tubing 22 so that fluid can seep about the piston member 162 at such times that the piston assembly 138 is at rest on pin 136. However, such difference in diameters is made small so that, under dynamic conditions in which a pressure differential across the piston assembly 138 drives the piston assembly 138 upwardly in the tubing 22, liquid between the outer periphery of the piston member 162 and the inside wall of the tubing 22 will form an effective seal therebetween, an effect that can be enhanced by a plurality of grooves 164 formed in the outer periphery of the piston member 162 to extend circumferentially thereabout. In one preferred embodiment, a suitable diameter for the piston member 162 has been found to be one and seven-eights inches where the inside diameter of the tubing 22 is two inches. The piston member 162 has a central bore 166 that mates with the periphery of the mandrel 140 and the piston member 162 is mounted on the mandrel 140 by sliding the bore 166 of the piston member 162 over portions of the mandrel 140 between the lower end 146 thereof and the ring 154 and subsequently securing the piston member 162 on the mandrel 40 via a spacer 168 and a nut 170, the latter screwing onto the mandrel via threads formed on the mandrel at the lower end 146 thereof.

OPERATION OF THE PREFERRED EMBODIMENT

During the operation of the apparatus 10, the tubing 22 is extended into the casing 12 a distance sufficient to immerse the lower end 98 of the tubing 22 in liquids that accumulate in the casing 12. Accordingly, as such liquids, and natural gas, enter the annulus 24 between the tubing 22 and casing 12, the liquids and natural gas will be forced into the strainer 104 by the natural gas pressure to enter the lower end of the tubing 22, the valve 102 opening in response to the natural gas pressure and liquid to admit these fluids into the tubing 22. The fluids will travel up the tubing 22 and pass through the passages 130 to accumulate above the pin 136 a distance determined by the pressure exerted by the natural gas. Thus, by moving the piston assembly 138 between the pin 136 and the mandrel arresting assembly 52, a quantity of well liquids can be raised to the outlet conduit 64.

In order to use natural gas pressure to cause such movement of the piston assembly 138, the pressure "fingerprint" of the well is first determined by means of suitable pressure gauges that can be placed into fluid communication with the tubing 22, for example, via the valve 46. Once such "fingerprint" is known, the valve 66 is set to open periodically with the timed interval between successive openings of the valve 66 being set equal to the time required for natural gas pressure in the well to recover following the release of such pressure.

Following the measurement of the "fingerprint" of the well, the well is closed in at the valve 97 and the upper portion 34 of the tubing 22 is removed, at the coupling 40, to permit the piston assembly 138 to be introduced into the tubing 22. During such introduction, the plunger 70 of the catcher assembly 72 is extended as shown in FIG. 2 so that the piston assembly 138 will be in a position near the upper end of the tubing 22. The upper portion 34 of the tubing 22 is then replaced and the valve 97 opened.

The mandrel 140 is constructed to be of a length such that the frusto-conical head 142 thereof will engage the piston 54 of the mandrel arresting assembly 52, to compress the spring 58, so that the piston assembly 138 can be accelerated down the tubing, following the opening of the valve 97, by withdrawing the plunger 70 from the casing 22. (If need be, the well can be bled via the valves 46 and 66 to insure that the piston assembly 138 is forcefully urged down the tubing 22.) Since the force of the mandrel arresting assembly 52 is applied to the mandrel 140, the resulting acceleration of the mandrel 140 will cause the slide 156 to rise on the mandrel 140 to abut the shoulder 152. Thus, the fluid path formed through the piston assembly 138 by the mandrel bore 148 and ports 150 will become open to prevent any pressure buildup in lower portions of the tubing that might impede the fall of the piston assembly 138. Accordingly, the piston assembly will eventually come to rest on the pin 136 so that the slide 156 will come to rest on the ring 154 closing the fluid path through the piston assembly 138. The timing of the valve 66 is then started so that operation of the apparatus will commence after a time period equal to the time required for the natural gas pressure to recover following release of such pressure. During this period, the fluid level and natural gas pressure in the tubing will stabilize at a level and a pressure which will be characteristic of the "fingerprint" of the well, the fluids in the well seeping about the piston member 162 to effect such stabilization.

At the end of the selected time period, the timed valve 66 automatically opens to relieve any natural gas pressure above the piston assembly 138 with the result that natural gas pressure in the well will force the piston assembly 138 and any liquid thereabove upwardly in the tubing 22. Such liquid will be delivered to the outlet conduit 64. Near the upper end of the tubing 22, the mandrel 140 will come into engagement with the piston 54 of the mandrel arresting assembly 52 so that the mandrel arresting assembly 52 will exert a force on the mandrel 140 to halt the upward movement of the piston assembly 138. That is, the mandrel arresting assembly 52 will cause a deceleration of the mandrel 140, directed oppositely the velocity thereof, near the upper end of the tubing 22. Such deceleration, toward the upper end of the tubing 22, will result in the slide 156 moving upwardly on the mandrel 140 to uncover the ports 150 and thereby open the fluid path through the piston assembly 138 formed by such port and the mandrel bore 148. Thus, natural gas pressure below the piston assembly 138 will be relieved to permit the piston assembly 138 to again return to the pin 136 near the lower end of the tubing 22. Following the discharge of well fluids via the outlet conduit 64, the valve 66 is timed to close so as to permit natural gas pressure to again build up in the casing 12 and force liquids into the tubing 22 via the open lower end 98 thereof. (The time required for movement of the piston assembly 138 upwardly in the casing can be measured and the valve 66 set to close during the fall of the piston assembly 138 to the pin 136). Such liquids will seep about the piston member 162 so that, at the end of the period during which the timed valve 66 is closed, the natural gas pressure in the well and the level of liquids above the piston assembly 138 will again have stabilized so that the above described operation of the apparatus to lift a quantity of liquid to the outlet conduit 64 can be repeated. Thereafter, such repetitions of the operation of the apparatus 10 occur at regular intervals determined by the setting of the timed valve 66.

At times, it will be useful to bring the piston assembly 138 to the surface without regard to the state of natural gas pressure in the casing 12 and the provision of the apparatus 10 with the downhole packer 106, the pipe 30 via which compressed gas can be introduced into the annulus 24, and the valve assembly 112 permits such movement of the piston assembly 138 at such times. For example, it might be desirable to cycle the piston assembly 138 upwardly and downwardly in the tubing 22 to remove paraffin deposits that have formed on the inside wall of the tubing 22 or it might be desirable to remove liquid from the tubing 22 when insufficient natural gas pressure is present. At these times, compressed gas is introduced into the annulus 24 via the valve 32 and such gas will pass down the annulus 24 to the aperture 108, through the bored plugs 110, and into the bore 116 of the vent body 114. From the vent body 114, the gas will enter the tube 122, open the valve 124, and traverse the extension tube 126 to be introduced into the lower portions of the tubing 22. The pressure exerted by the compressed gas will close the valve 102 so that the gas is directed upwardly through the passages 130 in the vent body 114 to exert a force on the piston member 162 and thereby raise the piston assembly 138 to the surface.

It will be noted that the lifting of the piston assembly 138 using compressed gas will in no way interfere with the buildup of natural gas pressure in the well because the valve 102 will close to isolate the well from the tubing 22 when compressed gas is introduced into the tubing 22. Moreover, the provision of the apparatus 10 with this additional liquid lifting capacity will in no way interfere with the automatic operation of the apparatus 10 because of the positioning of the valve 124 to permit fluid passage only from the annulus 24 to the tubing 22. That is, natural gas that enters the lower end 98 of the tubing 22 will be prevented from entering the upper portion of the annulus 24 by the valve 124 so that such gas will be directed through the passages 130 in the vent body 114 to provide the motive force for driving the piston assembly 138 up the tubing 22.

It will also be desirable, at times, to remove the piston assembly 138 from the tubing 22; for example, for cleaning the piston assembly 138, and the catcher assembly 72 provides the apparatus 10 with such a piston assembly removal capability. In particular, at such times that it is desired to remove the piston assembly 138 from the tubing 22, the plunger 70 of the catcher assembly 72 is extended into the tubing 22 by turning the knob 92 to project the nose of the plunger 70 through the aperture 68. When the piston assembly 138 is subsequently driven toward the upper end of the tubing 22, either by natural gas pressure or by the introduction of compressed gas in the apparatus 10 via the pipe 30, the frusto-conical head 142 of the mandrel 140 will engage the plunger 70 to momentarily force the plunger 70 into the catcher assembly body 78. The plunger 70 will subsequently be urged inwardly by the spring 88 to engage the lower end of the piston assembly 138 thereby maintaining the piston assembly 138 near the upper end 38 of the lower portion 36 of the tubing 22. Thereafter, the valve 97 is closed and any pressure in the tubing 22 above atmospheric pressure is relieved via the valve 46 to permit removal of the upper portion 34 of the tubing 22 at the coupler 40. The piston assembly 138 is then withdrawn from the tubing 22 through the upper end 38 of the lower portion 36 of the tubing 22.

It is clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. An apparatus for using natural gas pressure in a well to pump liquids from the well, comprising:

a casing disposed in the well to extend from an upper end thereof adjacent the earth's surface to a liquid and gas producing formation, wherein portions of the casing within said formation are perforated to permit liquids and natural gas to accumulate within said casing;

a tubing, having a closed upper end and an open lower end, the tubing passing through the upper end of the casing and sealed thereto to close the well, and the tubing extending downwardly within the casing a distance sufficient for portions of the tubing near the lower end thereof to extend into accumulated well liquids, whereby natural gas pressure in the well will force liquids into the tubing;

a piston assembly disposed in the tubing for sliding movement therein, comprising:

a mandrel;

a piston member mounted on the mandrel and having an outside diameter slightly smaller than the inside diameter of the tubing so as to permit liquid to seep about the piston assembly in a static condition of the piston assembly within accumulated well liquids while forming a seal with the tubing in a dynamic condition of the piston assembly wherein a pressure differential across the piston assembly and liquid disposed thereabove drives the piston assembly toward the upper end of the tubing; and sliding valve means on the mandrel for opening a fluid path through the piston assembly in response to a force exerted on the mandrel to accelerate the mandrel toward the lower end of the tubing while closing said path in a static condition of the mandrel;

stop means disposed in the tubing near the lower end thereof for supporting the piston assembly at a location within accumulated well liquids, whereby the sliding valve means closes said fluid path at such times that the piston assembly rests upon the stop means;

an outlet conduit mounted on the tubing and fluidly communicating with portions of the interior of the tubing near the upper end thereof;

a timer operated valve disposed in the outlet conduit for periodically relieving pressure above the piston assembly, thereby enabling natural gas pressure in the well to drive the piston assembly and liquids disposed thereabove toward the upper end of the tubing;

mandrel arresting means disposed within portions of the tubing near the upper end thereof for exerting a force on the mandrel to decelerate the mandrel, thereby operating the sliding valve means to open the fluid path through the piston assembly, whereby natural gas pressure below the piston assembly can be relieved to permit the piston assembly to fall to the stop means;

a standing valve disposed in the tubing between the stop means and the lower end of the tubing, said valve being disposed so as to be operable to permit fluid passage from the casing to the tubing but inoperable to permit fluid passage from the tubing to the casing; and means for injecting pressurized gas into the tubing between the stop means and the valve, comprising:

a downhole packer mounted on the tubing below the stop means to provide a seal between upper and lower portions of the annulus between the tubing and casing, wherein at least one aperture is formed through the tubing between the downhole packer and the stop means;

standing valve means disposed in the tubing to communicate with said aperture for admitting pressurized gas in the upper portion of said annulus into the tubing while preventing escape of fluids from the tubing to the annulus; and means for introducing compressed gas into said annulus at the upper end of the casing.

2. The apparatus of claim 1 further comprising catcher means near the upper end of the tubing for retaining the piston assembly in a position within the tubing near the upper end thereof.

3. The apparatus of claim 2 wherein the tubing comprises:

a lower portion whereon the catcher means is mounted;

an upper portion; and means for attaching the upper portion atop the lower portion; and wherein the apparatus further comprises a full bore valve disposed in the lower portion of the tubing below the catcher means.

* * * * *